United States Patent [19]

Reeves

[11] 4,066,529

[45] Jan. 3, 1978

[54] METHOD OF DESIGN FOR VERTICAL OIL SHALE RETORTING VESSELS AND RETORTING THEREWITH

[75] Inventor: Adam A. Reeves, Rifle, Colo.

[73] Assignee: Paraho Corporation, Grand Junction, Colo.

[21] Appl. No.: 684,001

[22] Filed: May 7, 1976

[51] Int. Cl.[2] ..... C10G 1/02

[52] U.S. Cl. ..... 208/11 R; 201/34

[58] Field of Search ..... 208/11 R; 201/29, 34

[56] References Cited

U.S. PATENT DOCUMENTS

| | | | |
|---|---|---|---|
| 3,736,247 | 5/1973 | Jones et al. | 208/11 R |
| 3,841,992 | 10/1974 | Jones et al. | 208/11 R |

*Primary Examiner*—Herbert Levine
*Assistant Examiner*—James W. Hellwege
*Attorney, Agent, or Firm*—Richard D. Law

[57] ABSTRACT

A method of designing the gas flow parameters of a vertical shaft oil shale retorting vessel involves determining the proportion of gas introduced in the bottom of the vessel and into intermediate levels in the vessel to provide for lateral distribution of gas across the vessel cross section, providing mixing with the uprising gas, and determining the limiting velocity of the gas through each nozzle. The total quantity of gas necessary for oil shale treatment in the vessel may be determined and the proportion to be injected into each level is then determined based on the velocity relation of the orifice velocity and its feeder manifold gas velocity. A limitation is placed on the velocity of gas issuing from an orifice by the nature of the solid being treated, usually physical tests of gas velocity impinging the solid.

7 Claims, 3 Drawing Figures

METHOD OF DESIGN FOR VERTICAL OIL SHALE RETORTING VESSELS AND RETORTING THEREWITH

This invention resulted from work done under Lease Agreement dated May 11, 1972, between the United States (represented by Honorable Rogers C. B. Morton, Secretary of the Interior) and Development Engineering, Incorporated.

This invention relates to the method of designing gas flow equipment and operation of gas flows in vertical shaft vessels, in which a bed of particulate matter is treated with gas. One type of treatment of particulate matter is by a hot gas. The treatment usually involves a chemical reaction, and may be either an endothermic or exothermic chemical change. Some examples, of pyroreactions in a vertical kiln includes calcining, pyrolysis (as conversion of kerogen of oil shale into shale oil and gas), absorption (as absorption and chemical change of gas or vapors on a particulate absorbent), gas conversions (as hydrocarbon conversions by heat and/or catalysis), etc.

In some operations of a vertical vessel, a continuous process is achieved by maintaining a gravity flow of the particulate material in the column. This is accomplished by introducing particulate matter into the top of the vessel and withdrawing particulate matter from the bottom maintaining a constant bed height. A stream of cool gas is usually introduced into the bottom of the bed, in pyrolysis reactions, passing upwardly through the bed to help conserve the heat inventory, as the rising gas is heated by the particulate matter. The solid is in turn cooled by the incoming cool gas. The reactant gas is injected into the bed at upper portions (one or more injection levels in the particulate bed). This gas mixes with the uprising gas, reacts with the particulate matter, and the combined gas with the produced vaporous and gaseous products are disengaged from the solids and withdrawn from the vessel.

The economic operation of the vertical vessels requires optimum flows of the solid material as well as the gas streams. Small laboratory sizes, pilot plant models and commercial or semiworks plants require careful sizing and positioning of the gas injection points in the particulate bed as well as the rates of introduction. One critical requirement in the operation of the vessels involves the substantial equivalent treatment of each particle by the gas. The gas injection equipment, therefore, must have the ability to inject gas across the full cross-sectional extent of the vessel at the level of each of the particular gas entry locations. This prevents channeling, etc. of the gas. With large diameter vessels there is a considerable design problem to provide a uniform quantity of gas to each unit of the total cross sectional area, at a particular level, and not impede the downward flow of the particulate matter. One effective design is to provide a series of parallel, straight gas distributor pipes from one side to the other side of the vessel at a particular level. Each distributor is provided with a plurality of openings on opposite sides of each pipe, so to distribute gas into the bed on both sides. This type of gas distributing arrangement is shown in U.S. Pat. No. 3,432,348 issued Mar. 11, 1969 and U.S. Pat. No. 3,599,611 issued June 29, 1971, etc. The design provides for the introduction of quantities of gas at the introduction level to provide the same quantity of gas into each unit of area across the lateral extent of the vessel.

The design for the gas equipment involving control of the gas injection has, heretofore, been based on the exit velocity of gas out of the orifices, as reflected in the pressure drop across each orifice. With introduction of gas into one end only of each distributor pipe, an adverse effect on the gas distribution is found, due to the impact of the gas against the closed end of the pipe. With this arrangement, it is found that the size of the holes no longer controls the gas rate in proportion to hole size. It is to be noted, however, at very high pressures, good control can be achieved, but this requires high compression of the gas to achieve the high pressure drop across the orifice. High compression of large quantities of gas is very costly.

One limiting factor in the gas distribution is the gas velocity out of the orifice. At a high velocity, the solid will generally be abraded, and the resulting small particles and dust will be carried over in the gas. The velocity of gas issuing from the gas injection orifices is in a range of 80–150 feet per second. The type of solid, therefore, determines the maximum velocity that may be used. For example, with oil shale, a gas velocity of over 150 feet per second causes serious abrasion of the shale which produces highly detrimental operating conditions. Another limitation is the quantity of the gas necessary to provide treatment; for example, at least 400,000 BTU per ton of oil shale is required to provide optimum pyrolysis. The quantity of gas to convey this heat is easily calculated at the desired temperature, e.g. about 10,000 SCF/Ton of gas at 1400° F. is desired for pyrolysis of oil shale in addition to about 1000 SCF/Ton of cooling gas added to the bottom for cooling the retorted shale and conserve the heat inventory. Obviously too much gas tends to carry over large quantities of solids, with more and larger sizes carried over as the volume (and the velocity) increases. Too little gas reduces the effeciency of the solid treatment. The total flow of gas through the vessel ranges from 8000 to 25000 standard cubic feet of gas per ton of particulate material.

According to the present invention there is provided a method for determining the design parameters of gas introduction orifices into a vertical vessel using gas to treat a column of particulate material in the vessel, and a major object and advantage of the invention is to provide such a method.

Another object of the invention is to provide a method for determining the design parameters for the gas streams injected into a column of particulate material in a vertical vessel.

Still another object of the invention is to provide a method for determining the design parameters of the material streams entering a vertical vessel to provide optimum material treatment in the vessel with minimum disruption of the materials.

Yet another object of the invention is to provide a method of determining the design parameters of the gas streams injected into a column of particulate oil shale with optimum gas shale contact to produce maximum pyrolysis with minimum degradation of the oil shale.

These and other objects and advantages of the invention may be ascertained by reference to the following description and appended illustrations in which.

Figure 1:
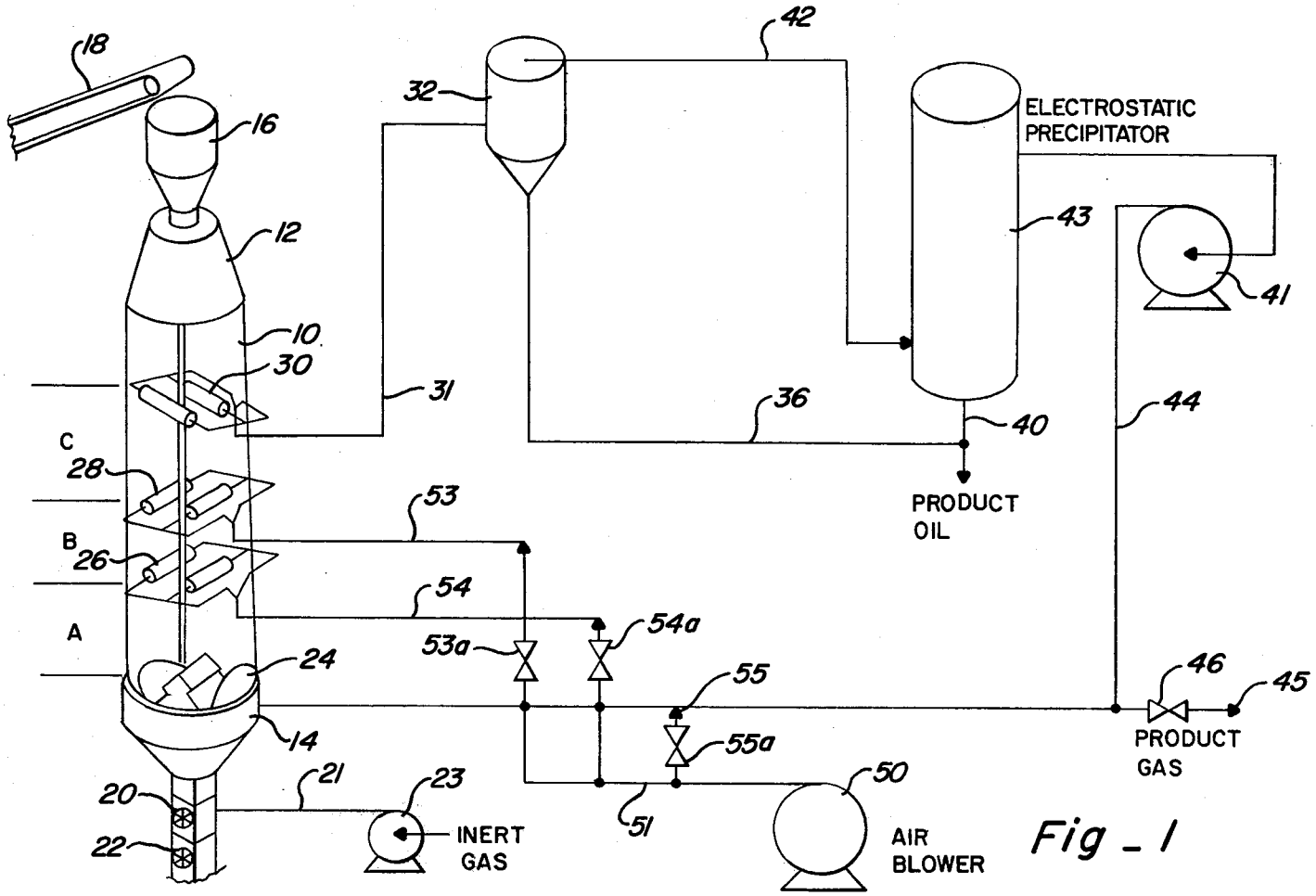
FIG. 1 is a schematic perspective of one form of vertical vessel considered in the method of the invention, illustrating multiple levels of injection of gas into a volume of particulate material.

In one form of the invention, FIG. 1, a vertical vessel 10, is provided with a top cover 12, through which solid, particulate material is fed, with a depending surge bin 16, for holding particulate material being fed in the vessel. A belt conveyor 18 feeds the bin 16. The bottom of the vessel is closed by a conical cover 14 which discharges into a double rotary valve which includes rotary discharge member 20 and rotary discharge member 22 spaced therefrom. To prevent gas loss from the particulate discharge means, a purge gas is introduced through line 21 into the mechanism, usually between the two rotary valves. Inert gas under pressure, to prevent loss of gas from the vessel, is passed in the line 21 from a blower 23. Particulate matter is discharged from the vessel 10 through a grate mechanism 24 (not shown) into the cone 14. The grate may be a mechanism such as shown in U.S. Pat. No. 3,401,922, patented Sept. 17, 1968 for LINEAR GRATE FOR SHAFT KILNS, etc. Gas is introduced into the column of particulate material in the vessel 10 through the grate means or immediately thereabove. One means of injecting gas into the bottom of the column is shown in U.S. Pat. No. 3,777,940, patented Dec. 11, 1973 for BOTTOM FLUID DISTRIBUTOR FOR SHAFT VESSELS.

Gas may be distributed into an upper portion of the column by means of tubular distributors 26 at one level and tubular distributors 28 at a higher level. Both such distributors are enclosed within the column of particulate material. U.S. Pat. No. 3,432,348, patented Mar. 11, 1967 for FLUID DISTRIBUTOR FOR VERTICAL VESSELS and U.S. Pat. No. 3,589,511, patented June 29, 1971 for DISTRIBUTORS FOR INJECTING FLUIDS, both show forms of distributors highly useful for injecting gas into vessels and into a column of crushed rock or ore. Off-gas from the unit is collected in the collectors 30 and passed through line 31 into a liquid recovery means 32, as by means of a wet cyclone or other liquid recovery device. Off-gas may be collected in collectors submerged in the bed of particulate matter or it may disengage from the bed, collect in the space thereabove and be withdrawn from the vessel. The liquid removed from the gas is passed through line 36 to a product oil line. An electrostatic precipitator 43 completes the removal of mist particles from the off-gas, and it is fed by the line 42 from the cyclone. Clean gas passes through a pump or blower 41 into line 44, partly to product gas line 45, through control valve 46, and partly into the vessel 10. Air from air blower 50, through line 51 into line 55 and controlled by control valve 55*a*, may be added to the bottom gas. Air, usually mixed with the recycle gas, is passed from the blower 50 through control valves 53*a* and 54*a* respectively, into lines 53 and 54. These lines may, also, be fed with recycle gas and the air-gas mixture is injected into the upper and middle gas distributors 28 and 26.

As shown in the patents for injection of gas into columns of particulate matter, distributors or gas injection lines are essentially straight, tubular arrangements extending from side to side in a vertical vessel. The tubes are preferably cooled with a cooling fluid. The size of the vessel determines the number of the distributors which will be required on each level. The distributors are provided with gas orifices spaced along opposite sides of the distributor, and the spacing and/or the size of the individual gas injection orifices is arranged to provide an equal volume of gas to each unit of area or cross-sectional segment of the lateral extent of the vertical vessel, to provide uniform gas treatment of all the particles in each such segment. Thus, with the proper number of distributors each with the predetermined number, size and spacing of the jets, a uniform quantity of gases can be spread completely across the cross-sectional extent of the vessel.

As shown in FIG. 1, gas is introduced into the bottom of the vessel at about the grate outlet of the solid material, and at two levels intermediate the bottom of the column and the top of the column of solid, particulate material. Therefore, the bed volume A between the grate and the lower distributor 26 is provided only with gas injected into the gas distributor of the grate mechanism. The volume B, between the lower distributor 26 and the upper distributor 28, includes the uprising gas from the bottom injector as well as the gas injected by the distributors 26. The volume C, between the upper distributor 28 and the off-gas collectors 30, is subjected to the gas uprising from the bottom injector and the gas from the two distributors 26 and 28. Thus, it is easily seen that there is a substantial difference in the volume of the gas in each of bed volumes from the bottom to the top of the column. In one developement, it was found that if gas is supplied to a distributor from a single end, the impact from the gas against the closed end adversly effects distribution of the gas through the orifices and the sizes of the orifices no longer control the gas discharge rate in proportion to the size of the orifices. It was found, therefore, that for acurate distribution of gas into the vessel and its discharge from the distributor it must be introduced into both ends of the distributor, at generally the same pressure, as by a bustle pipe.

Figure 2:
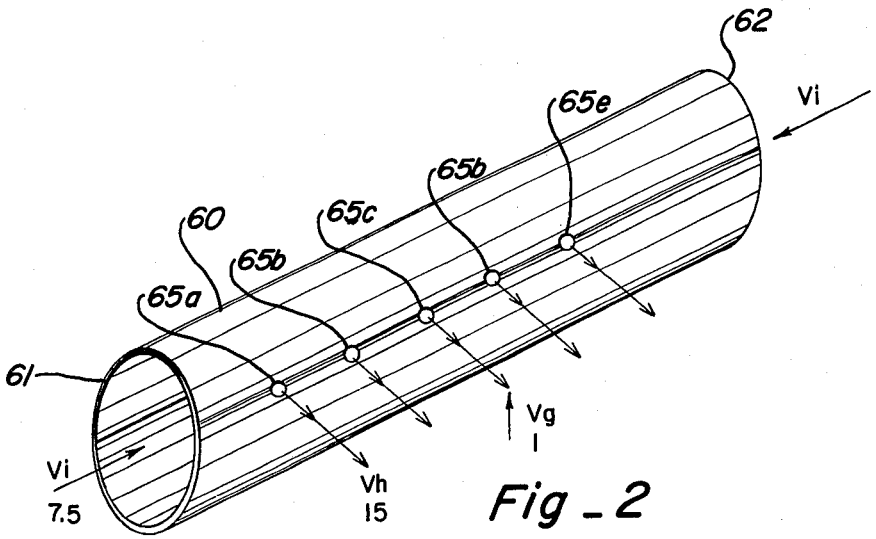
FIG. 2 is a schematic presentation of a distributor for a gas stream injected into a vertical vessel, showing the relationship of the streams.

As shown in FIG. 2, a tubular distributor 60 has its ends 61 and 62 provided with a flow of gas at a velocity Vi, thus providing the equivalent quantity of gas at each end of the distributor 60. This provides a uniform pressure of gas at both the ends. The distributor is shown schematically, and the cooling jacket and orifice passages are not shown. The actual cross-sectional shape of the tubular distributor may be circular, oval, rectangular, etc. depending on the desires of the designer. Also, separated passages may be provided in the distributor for different gases or different pressures or the like to provide variation in the control of or a change in the reaction. A series of orifices 65*a* through 65*b* are provided at the side of the distributor 60, and it is understood that another series of orifices, not shown, are mounted in the other side of the distributor. The size and the spacing of the distributors are determined by the position of the distributor in the vessel and in relation to the wall of the vessel. As pointed out in the above patents by segementing the cross-sectional area inside of a vertical vessel into arbitary equal segments, the orifices may be spaced and sized to provide an equivalent amount of gas into each of the segments. Gas is issued from each of the orifices 65 at a velocity Vh, at the minimum diameter of each distributor, however, uprising gas is passing the distributor at a velocity of Vg and, thus, the following definitions are provided.

Vi is the distributor inlet velocity.

Vh is the orifices velocity.

Vg is a gas velocity from below based on an empty vessel. With oil shale, it has been found that velocity of around 100 feet per second impinging on the shale tends to cause degradation of the shale and, therefore, the velocity distributed from each orifices should be less than about 100 feet per second. It has, also, been found that the minimum diameter of the orifice controls the flow of gas from the orifice. The ratio of the orifice velocity to the inlet pipe or distributor velocity is preferably in the range of 2.72 to 12.3, thus, the ratio of Vh/Vi of at least about 2 is an acurate criterion for the distribution of the quantity of gas, rather than the pressure drop through the orifices. It may be possible to achieve control by the use of high pressure drop across the orifice, but the power requirement to produce the high pressure necessary to produce high pressure drops is very costly, particularly in view of the large quantities necessary in large vessels. Thus, the control of the ratio of the velocity provides good distribution of the gas into the vessel at low pressure drops and at a low pressure drops and at a low pressure. It is possible to calculate a ratio of an orifice velocity to the velocity of the upcoming gas to provide good lateral distribution of the gas injected from the orifices. In actual measurements made in a vertical, semi-works kiln, an 8½ foot inside diameter vessel, the ratio was found to be about 19. The designed criterion of Vh/Vg is at least about 15 to 1 to provide proper gas distribution laterally of the vessel.

Figure 3:
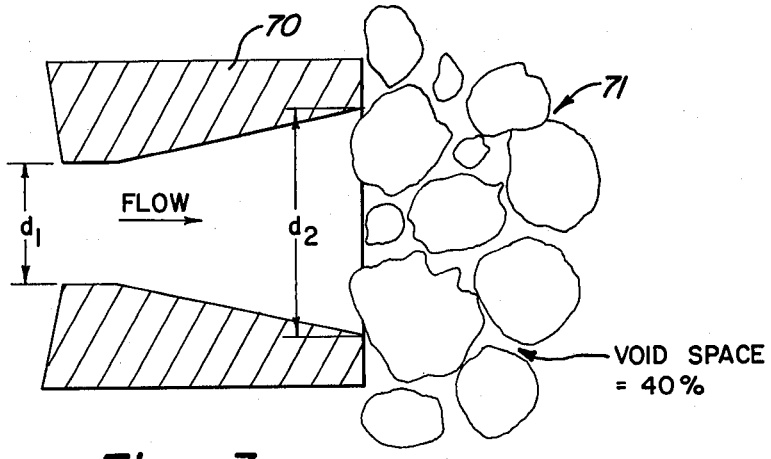
FIG. 3 is a schematic cross-section of a divergent gas injection nozzle, showing the size relationship of inlet and outlet diameters thereof to the solid particles to be treated.

The shape of a prefered orifice is shown in FIG. 3, wherein the minimum diameter $d_1$ is the minimum orifice size for determining the velocity of gas issuing through the orifice. However, to prevent a particle of the rock in the bed from blocking the orifice, the outer opening or the orifice is divergent, and the diameter $d_2$ should be larger than the average particle size of the bed. The particulate matter 71 is shown as a series of sizes of rock, and in a size consist of + ⅜ to − 2½ inches there is approximately a 40% void space in the column. The $d_2$ diameter is preferably made of a size which substantially reduces the chance of an oil shale particle sealing the opening of the orifice. The inner or smaller diameter $d_1$ controls the flow of gas. The ratio of $d_2$ to $d_1$ must be at least 1.58 to 1. The velocity in the void spaces is somewhat less than the velocity in the orifice with a minimum diameter of $d_1$.

The following table shows the relationship of two vertical kilns as well as the limiting case therebelow:

TABLE A

| Vessel No. | Orifice Diameter in inches | | | Area in Sq. inches | | Relative Velocities | | |
|---|---|---|---|---|---|---|---|---|
| | $d_1$ | $d_2$ | $d_2/d_1$ | $A_1$ | $A_2$ | $d_1$ | $d_2$ | in bed |
| 1 | 11/16 | 1 1/2 | 2.19 | 0.37 | 1.77 | 1 | 0.21 | 0.53 |
| 2 | 1 1/16 | 2 | 1.87 | 0.87 | 3.14 | 1 | 0.27 | 0.71 |
| Limiting Relative Dimensions | 1 | 1.58 | 1.58 | 0.79 | 1.96 | 1 | 0.40 | 1.0 |

The relationship of the various velocities may be readily seen in a vertical vessel for the pyrolysis for the Western oil shale. For example, with sufficient recycle gas and air introduced into a ⅜ - 2½ inch size consist of oil shale, for a direct pyrolysis mode, experience has shown that the volume of gas leaving the top of the retort should be from 20,000 to 24,000 SCT/Ton of shale feed. This, of course, is distributed in the vessel by introduction of gas into the bottom of the kiln, the lower or middle distributor and the upper distributor. Since the oil shale has a pyrolysis temperature of over about 900° F. the actual velocity of the gas in the bed of shale may be readily determined, taking into account of to the expansion of the gas due to the temperature. The pressure of the gas in the kiln is normally only slightly more than atmospheric pressure, therefore, the temperature controls the gas volume in the vessel. The objective is to have the diameter $d_1$ control the flow of gas out each orifice. The ratio of $d_2/d_1$ must be at least about 1.58 to 1 so that the velocity of the gas in the void space is somewhat less than the velocity in the minimum hole diameter $d_1$. This gives lateral distribution of the gas from the distributor and good mixing of the gas from the orifice with the uprising gas.

The small diameter of the orifice should be sharp-edged at the point of gas entry. The distance from the sharp edge to the start of the diverging passage should be no more than about ⅛ inch. This is different from the usual practice for thick orifice plates which are bevelled on the downstream edge to about the edge thickness. Excellant flow control is maintained, and penetration into the bed is assured.

What is claimed is:

1. In a process of contacting a particulate oil shale with a gaseous treating agent is a vertical shaft vessel, wherein a gravity flow of particulate oil shale passes through said vessel maintaining a constant bed depth by feeding raw oil shale at the top and removing treated particulate oil shale at the bottom, and a first gas stream for treatment is introduced into the bottom of the particulate oil shale, at least a second gas stream is introduced through orificed distributors at a temperature of up to about 1,400° F at a position intermediate the top and bottom of the bed of oil shale to cause pyrolysis of the same and off-gas is withdrawn from the vessel above said at least second gas injection the improvement comprising:

a. establishing a total flow of gas through the vessel of from 8,000 to 25,000 standard cubic feet of gas per ton of particulate oil shale;

b. proportioning said gases between a first point of introduction adjacent the bottom of the bed and into at least a second point of introduction located between the top and bottom of the bed, wherein a plurality of orifices spread the gas across the lateral extent of the bed, said orifices being fed by a stream of gas in a distributor conduit at a velocity of Vi feet per second;

c. providing a sufficient quantity of the gas introduced at the bottom of the bed so that it flows upwardly through the bed a velocity of Vg in feet per second, calculated on the basis of an empty vessel;

d. providing a quantity of gas through each said orifice at a sufficient velocity Vh of gas issuing from said orifices so as to mix with the uprising flow of gas from the bottom of the bed at a velocity Vh in the range of 80–100 feet per second; and e. proportioning the velocities of the introduced gases so that the ratio Vh/Vi is at least 2 and the ratio of Vh/Vg is at least 15 to control contact velocity between the gases and the particulate oil shale.

2. A method according to claim 1, wherein said gas is recycle gas.

3. A method according to claim 1, wherein said gas is recycle gas and air.

4. A method according to claim 1, wherein two streams of gas are injected into the bed of material by distributors at levels intermediate the top and bottom of the bed and one above and spaced from the other level.

5. A method according to claim 4, wherein the gas injected into the bed through said distributors is a mixture of air and recycle gas.

6. A method according to claim 1, wherein each orifice is a divergent nozzle having an inner diameter to outer diameter ratio of 1 to at least about 1.58.

7. A method according to claim 1, wherein each orifice is a divergent nozzle having a ratio range of an inner diameter to outer diameter of from 1/1.58 to 1/2.19.

* * * * *